United States Patent [19]

Richardson

[11] 4,127,193

[45] Nov. 28, 1978

[54] CARROT SORTING APPARATUS

[76] Inventor: Harry L. Richardson, 19710 Pinehurst La., Salinas, Calif. 93901

[21] Appl. No.: 796,982

[22] Filed: May 16, 1977

[51] Int. Cl.[2] ..... B07B 13/04

[52] U.S. Cl. ..... 209/539; 209/544; 209/678; 209/679

[58] Field of Search ..... 209/99, 98, 102, 73, 209/97

[56] References Cited

U.S. PATENT DOCUMENTS

| | | | |
|---|---|---|---|
| 2,295,190 | 9/1942 | Zenge et al. | 209/99 |
| 2,755,929 | 7/1956 | Prenveille | 209/99 |
| 2,934,207 | 4/1960 | Steber | 209/97 |

*Primary Examiner*—Allen N. Knowles
*Attorney, Agent, or Firm*—Cahill, Sutton & Thomas

[57] ABSTRACT

A sorting machine feeds longitudinally aligned carrots onto a transversely directed sloping conveyer. The conveyer, after first positioning one end of each carrot against a baseboard, transports the carrots past progressively longer supporting rods parallel to but progressively displaced from the baseboard. The rods allow progressively incrementally longer carrots to drop through the conveyer into one of several bins. Thereby, each bin is filled with carrots of less than a predetermined length, which length is commensurate with the displacement from the baseboard of a respective one of the supporting rods.

3 Claims, 4 Drawing Figures

CARROT SORTING APPARATUS

The present invention relates to sorting apparatus and, more particularly, to sorting apparatus for carrots.

For many years many attempts have been made to minimize the need for manual labor in sorting various vegetables. To date, the only mechanized sorters which are both practical, effective and efficient are those for vegetables sizeable through a grid. Most vegetables are not normally commercially readily sortable by machinery because of the dimensional variations and other non-uniformities of the vegetables. Hence, sorting of most vegetables is generally performed by manual labor despite the increasing unavailability of low cost itinerant farm labor and even though various sorting machines have been developed, as exemplified by the following patents. U.S. Pat. No. 645,703 is directed to apparatus for sorting tobacco leaves; U.S. Pat. No. 663,681 is directed to a sorting machine for sorting lineally distinguishable items; U.S. Pat. No. 2,755,929 is directed to a carrot length grader having a plurality of orthogonally oriented conveyers for aligning and grading the carrots; U.S. Pat. No. 2,934,207 describes a machine for grading pickles; and, U.S. Pat. No. 2,961,095 is directed to apparatus for sorting cucumbers, beans and the like by length.

A mechanized sorting machine for vegetables must have certain features in order to be of commercial importance. It must (a) be able to receive and process vegetables in an as picked state; (b) it must orient or otherwise align the vegetables transported from the receiving bin to the grading table; (c) it must be able to accommodate normally expected excursions in girth, width and length of the vegetable to be sorted; (d) it must sort the vegetables accurately as to size; (e) the sorting operation must avoid the possibility of jamming of the machine or otherwise disrupting the sorting operation; (f) the sorted vegetables must be collectable within segregated bins; and (g) handling of the vegetables must be gentle and minimized to reduce the possibility of bruising or damage to the vegetables.

Although there is a basic similarity between sorters of various types in terms of end result, each sorter must be specifically configured to meet the physical configuration and excursions therefrom of the particular vegetable to be sorted. Even though there may exist superficial similarities between sorters for vegetables or other types of crops, each sorter is unique in terms of the apparatus and function performed, as evidenced by the above enumerated patents. The patentable distinction in the sorting machinery art arises not only from the structure claimed but also from the inventive process necessary in comprehensively analyzing the problems at hand to accommodate for variations in size, shape and growth conditions of the to be sorted vegetable. Once the analysis has been completed, the machinery must be designed, built, tested and modified to satisfy all contingencies.

It is therefore a primary object of the present invention to provide apparatus for complete automated sorting of carrots.

Another object of the present invention is to provide a sorter which is capable of receiving carrots from a carrot supplying conveyer.

Still another object of the present invention is to provide a sorter for carrots which accommodates all carrot sizes.

Yet another object of the present invention is to provide a sorter for carrots having a single conveyer which both maintains the orientation of and grades the carrots as to length.

A further object of the present invention is to provide a carrot sorter wherein either the base end or the tip end may be used as a reference point for grading the carrots by length.

A still further object of the present invention is to provide a carrot sorter which employs a V-shaped open bottomed trough for effecting initial automatic alignment of the carrots.

A yet further object of the present invention is to provide a multi-compartment open bottom conveyer cooperating with a fixed carrot supporting surface for transporting carrots to be graded by length.

These and other objects of the present invention will become apparent to those skilled in the art as the description thereof proceeds.

The present invention may be described with more specificity and clarity with reference to the drawings, in which.

Figure 1:
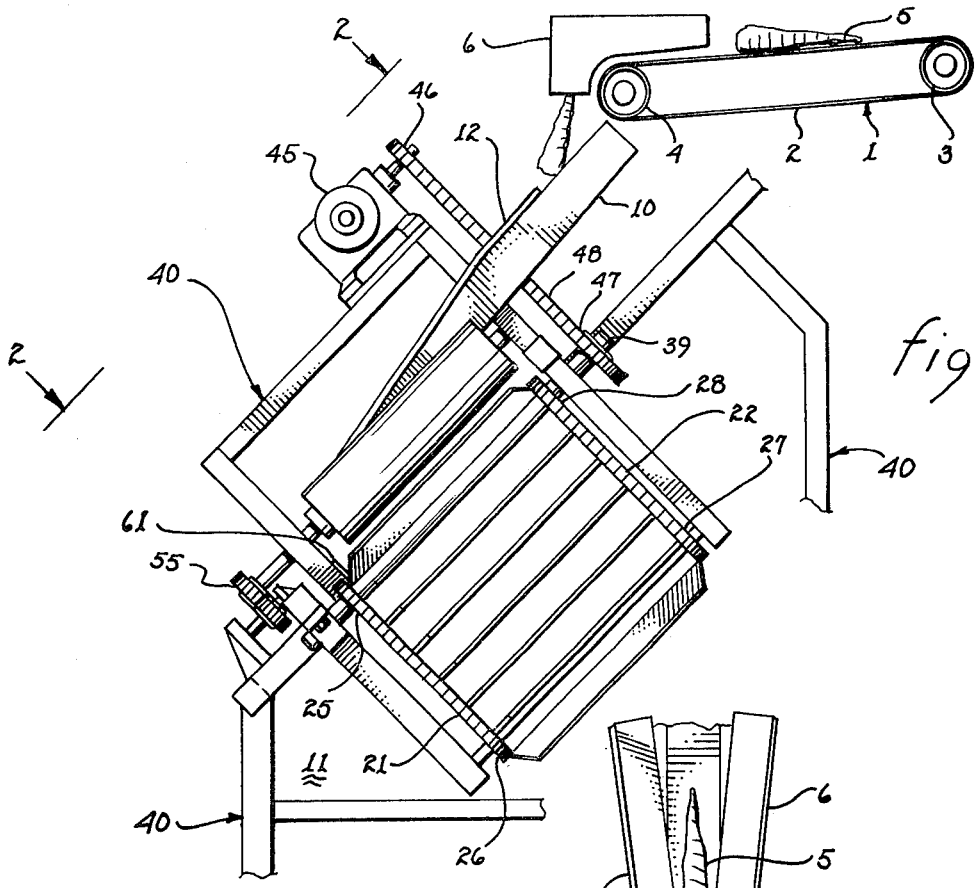
FIG. 1 is a side view of the operative elements of the present invention.

The overall structure and operation of the carrot sorter will be described with initial reference to FIGS. 1 and 2. An initial conveyer 1 having a conveyer belt 2 mounted upon rotating drums 3 and 4 conveys carrots 5 from a source of carrots (not shown) to feed chute 10 of sorter 11. This conveyer may also serve the function of a shaker spreader to produce an even feed of the carrots. A pair of slanted opposed guides 6 and 7 are disposed at the discharge end of conveyer 1. These guides are set at an angle to collect carrots 5 transported by belt 2 and channel them into serial discharge off the belt. The channeling operation has the further benefit of generally aligning the carrots with the longitudinal axis of feed chute 10.

Figure 3:
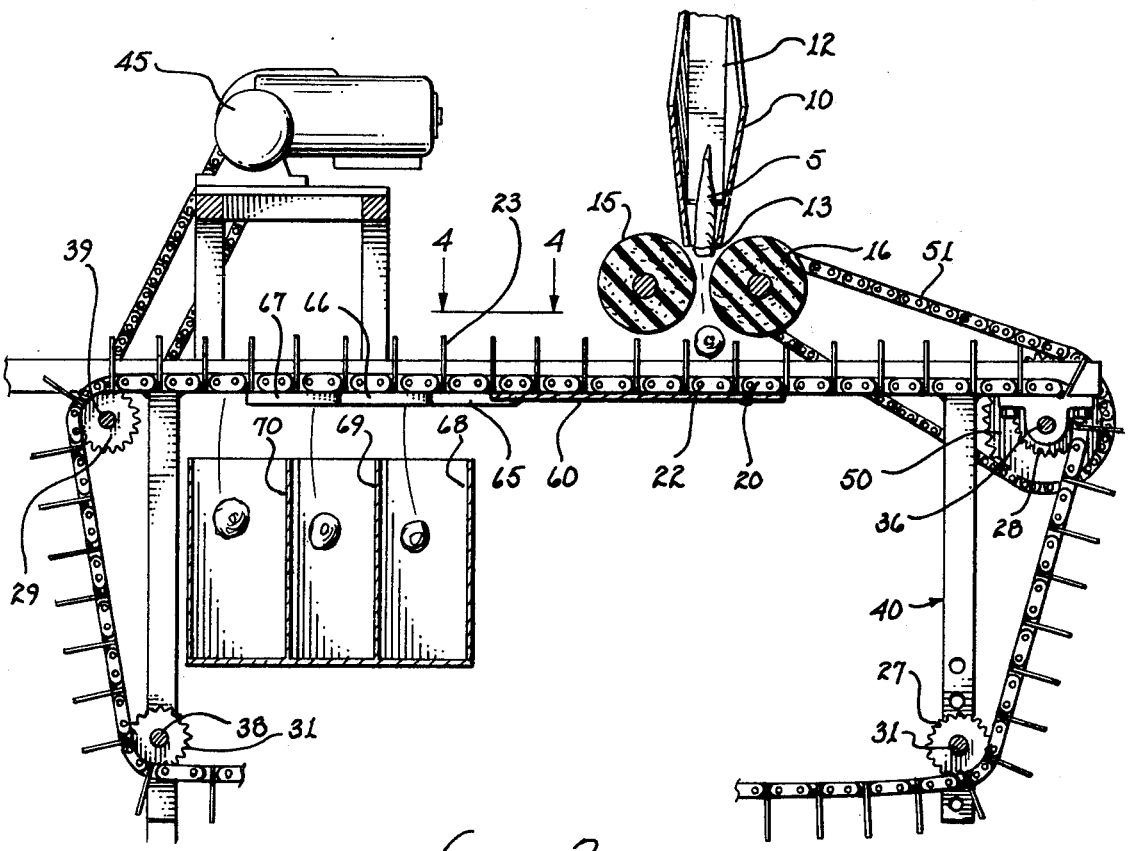
FIG. 3 is a partial cross-sectional view taken along lines 3—3, as shown in FIG. 2.
Figure 4:
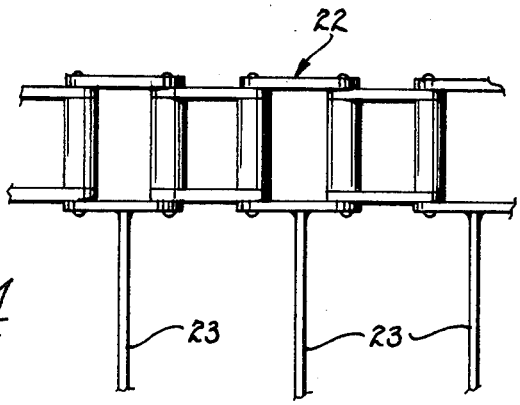
FIG. 4 is a detail view of the main conveyer and taken along lines 4—4, as shown in FIG. 3.

Feed chute 10 is generally V-shaped in cross-section and is set at a relatively steep angle whereby the carrots dropping thereinto tend to further align themselves with the longitudinal axis of the chute and slide therealong to the lower extremity of the chute. A guide plate 12 extends inwardly into the chute from the top edge of the chute in proximity to the receiving end for carrots 5. The purpose of the guide plate is that of forcing the carrots to the bottom of the V represented by chute 10 if they are nor already so positioned by gravity. The bottom lower end of chute 10 is open (as illustrated in FIG. 3) to form an aperture 13 through which the carrots drop from the chute. The downward slant within the chute of plate 12 forces the carrots through the aperture in the event gravity is insufficient for this purpose.

As illustrated in further detail in FIG. 3, the carrots discharged from chute 10 are discharged intermediate a pair of counter-rotating flexible rollers 15 and 16. These rollers may be of soft neoprene and 12 inches long by 4½ inches in diameter. The rollers grab or otherwise engage each carrot fully or partially extending from aperture 13 to withdraw the carrot from within chute 10 if necessary; otherwise, the rollers simply temporarily engage a dropping carrot and direct it into one of the compartments within an underlying conveyer 20.

Referring jointly to FIGS. 1–4, conveyer 20 is developed from a pair of endless link chains 21 and 22 interconnected by and supporting a plurality of slats or flights 23. These flights may be 1¾ inch high and spaced 2¾ inches apart from one another to define a plurality of adjacent compartments located along the full length of conveyer 20. It may also be noted at this point that conveyer 20 does not include any horizontal or other supporting elements for items positioned within one of the compartments. Chains 21 and 22 of conveyer 20 are supported by a plurality of sprockets, such as sprockets 25–31. These sprockets are mounted upon respective ones of shafts 36–39, which shafts are either rigidly or rotatably secured to a supporting framework for sorter 11, which framework is generally designated by numeral 40. Power for conveyer 20 is supplied by electric motor 45 having an output sprocket 46. Output sprocket 46 is operatively secured to a further sprocket 47 through chain 48 and sprocket 47 is affixed to shaft 39. Thereby, on energization of electric motor 45, sprocket 47 is caused to rotate resulting in rotation of shaft 39 and sprockets 29 and 30 attached thereto. The power for rollers 15 and 16 is supplied by a sprocket 50 secured to shaft 36, which shaft rotates in response to rotation of sprocket 28 and 25 through motion therepast of chains 21 and 22. A chain 51 interconnects sprocket 50 with sprocket 52 attached to shaft 53 of roller 16. A sprocket 55 is attached to the other end of shaft 53 to operatively interconnect with a sprocket 56 through chain 57. Chain 57 also engages an idler sprocket 58 rotatably mounted upon framework 40. By having the chain come off the top of sprocket 50 and engage the lower part of sprocket 56 and thence around pulley 58, counter-rotation of rollers 15 and 16 is achieved.

The operation of conveyer 20 may be briefly described as follows. On energization of electric motor 45, shaft 39 and sprockets 29 and 30 attached thereto are caused to rotate and sprockets 29 and 30 serve as drive sprockets for chains 21 and 22. The translation of the chains is conveyed to sprocket 50 through shaft 36 upon which sprockets 25 and 28 are rigidly mounted. Rotation of sprocket 50 results in translation of chain 51 and the resulting counter-rotation of rollers 15 and 16 through interconnecting chain 57.

In underlying proximity to and extending for a distance downstream of rollers 15 and 16, there is disposed a supporting plate 60. This plate is positioned adjacent to conveyer 20 and serves as a horizontal support therefor. In addition, plate 60 provides a horizontal supporting surface for each of the compartments of the conveyer translating therepast. A base board extending upwardly in perpendicular alignment with plate 60, is secured to framework 40 adjacent chain 21 and extending downwardly into the space evacuated by the cutaway slanted ends of flights 23. Plate 60 serves as a support for one end of the carrots disposed within each compartment of conveyer 20 and further serves as a reference point from which the length of the carrots are gauged.

Figure 2:
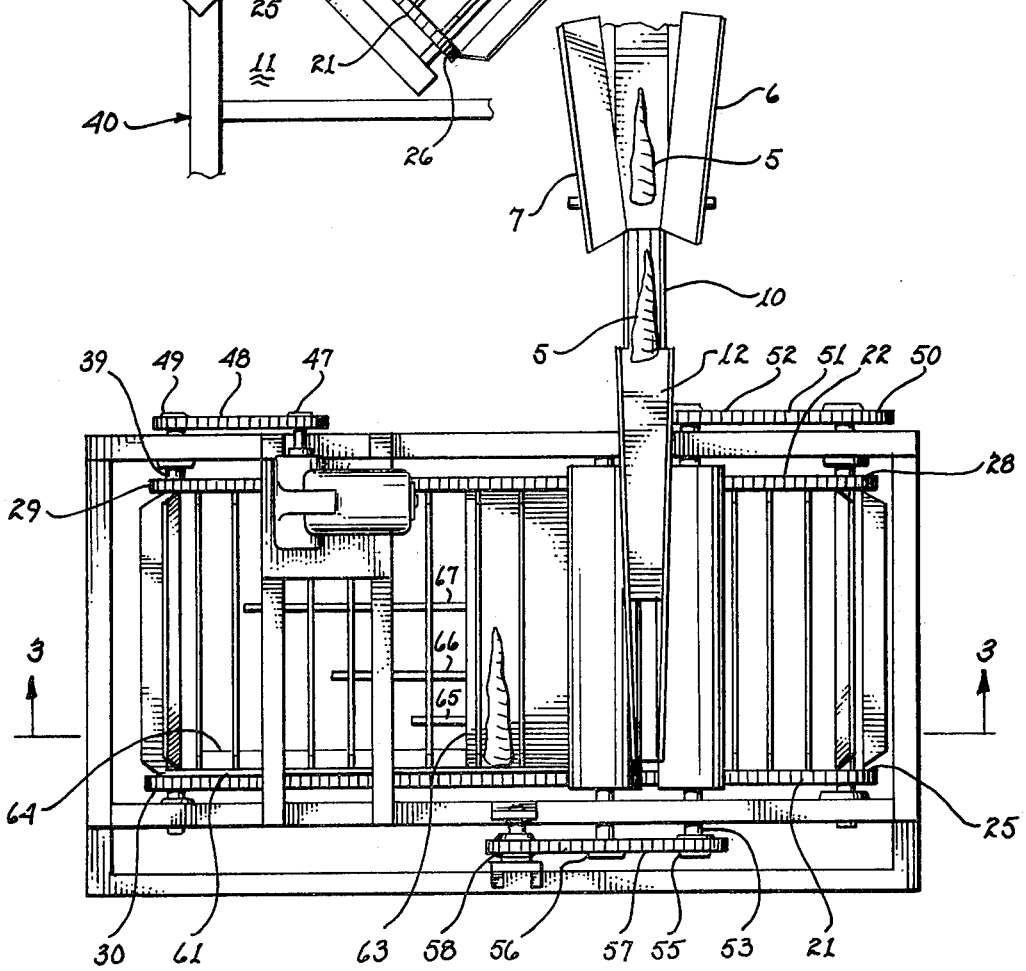
FIG. 2 is a plan view taken along lines 2—2, as shown in FIG. 1.

As particularly illustrated in FIG. 1, conveyer 20 is oriented at an angle of approximately 45° with respect to horizontal. This angle of the conveyer and the commensurate orientation of the compartments in proximity to plate 60 assures that any carrots dropped into any of the compartments will tend to slide and remain positioned against baseboard 61. The length of plate 60 is selected to insure that each carrot, after dropping into a compartment intermediate a pair of flights, has the opportunity to slide into a position adjacent the baseboard.

Downstream of end 63 of plate 60, the carrots disposed intermediate adjacent flights are supported in part by a horizontal strip 64 disposed beneath the flights and essentially adjacent the lower edge of baseboard 61. Further support for the carrots is provided by one or more of a plurality of downstream extending support rods 65, 66 and 67. These rods are of increasing length and increasingly incrementally displaced from strip 64. In example, rod 65 may be 6 inches long and spaced 3 inches from the baseboard; rod 66 may be 10 inches long and spaced 5 inches from the baseboard; rod 67 may be 18 inches long and spaced 7½ inches from the baseboard; and, a fourth rod (not shown) may be 24 inches long and spaced 10 inches from the baseboard.

In operation, the carrots discharged intermediate rollers 15 and 16 drop into one or another of the compartments or pairs of flights within conveyer 20. Horizontal support for the carrots is provided by plate 60 until such time as the carrots have been translated to end 63 of the plate. Thereafter, one end of each carrot, whether it be the tip or the base end, is supported by strip 64. The positioning of the tip or base end is assured by the slant of conveyer 20. A second point of support for each carrot is provided by rod 65 until such time as the carrot is translated past the extremity of this rod. In the event the carrot is of insufficient length to receive support from rod 66, the carrot drops into the first bin 68 disposed beneath conveyer 20. Longer carrots will continue to be supported by rod 66 until they are translated past its end; if these carrots be of insufficient length to be supported by rod 67, these carrots will drop into second bin 69. The remaining carrots, of sufficient length to be supported jointly by strip 64 and rod 67 will be translated by conveyer 20 until they pass past the end of rod 67; thereafter, these carrots will drop into third bin 70. Alternatively, the bins may be replaced by discrete conveyers.

The spacing intermediate baseboard 61 and rods 65, 66 and 67 is selected so as to represent conventional commercially sized carrots, as indicated above. Should any carrots be fed onto conveyer 20 which are too small for commercial purposes, they will drop through conveyer 20 on translation past end 63 of plate 60 since they will not be jointly supported by strip 64 and rod 65. A bin (not shown) can be employed to collect these non-marketable carrots.

From the above description it will become apparent that the driving mechanism for sorter 11, being a plurality of chain and sprocket systems, is relatively trouble free and capable of operating satisfactorily at in situ locations. Additionally, since the conveyer does not include any permanently developed compartments with dirt catching corners, cleaning thereof of dirt and debris transported to the conveyer by freshly picked carrots is relatively easy. In fact, the conveyer is, to a great extent, self-cleaning. The guide plates and positive transport of the carrots onto plate 60 cooperating with conveyer 20, insures that deformed carrots or the like will not clog up or otherwise disrupt the sorting process. The shaking, movement of giggling of the carrots intermediate adjacent flights resulting from the action of the moving flights and the non-moving or stationary plate 60 upon which they slide, provides sufficient jostling of the carrots to overcome friction and insure that the carrots, due to the slope of conveyer 20 and plate 60, slide to a position adjacent baseboard 61; thereby, accurate gauging by operation or rod 65, 66 and 67 will occur. Whether the tips of the base ends of the carrots are positioned adjacent baseboard 61 is of little consequence in that strip 64 and one or more or rods 65, 66 and 67 provide the necessary two point support for any carrot of a length sufficient to reach at least the closest rod.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim

1. A sorting apparatus for sorting carrots by length, said apparatus comprising in combination:

a. a source of carrots;

b. a feed chute means for receiving the carrots from said source, said feed chute including means for serially aligning the carrots along their longitudinal axis;

c. roller means for conveying the carrots from said feed chute;

d. conveyer means for transporting the carrots conveyed by said roller means, said conveyer means including a plurality of flights spaced apart from and parallel to one another and defining opposed sides of a compartment having open bottom and top sides;

e. plate means disposed in vertical proximity to said roller means and adjacent the lower edges of said flights for supporting the carrots disposed within said compartments and transported by said conveyer means, said plate means including a terminal end downstream from said roller means;

f. baseboard means disposed along one side of said conveyer means for referencing the location of the carrots disposed within each compartment;

g. framework means for orienting said plate means and at least the part of said conveyer means adjacent said plate means at an angle with respect to horizontal to urge sliding of the carrots to said baseboard means;

h. strip means extending downstream from said terminal end in general alignment with said baseboard for supporting one end of the carrots disposed within said compartments;

i. support rod means extending downstream from said terminal end and parallel to said strip means for providing a second point of support for the carrots disposed within said compartments; and j. bin means for receiving the carrots no longer supported by said support rod means;

whereby, after passage of the carrots past said terminal end, any carrots of insufficient length to be jointly supported by said strip means and said support rod means will drop through the open bottom side of said compartment into one of said bin means and the remaining carrots will continue to be transported within their respective compartments until they are no longer supported by said support rod means and drop into another of said bin means.

2. A sorting apparatus for sorting carrots by length, said apparatus comprising in combination:

a. means for aligning the carrots end to end and including discharge means for discharging the aligned carrots;

b. conveyer means for urging the carrots discharged from said discharge means in a direction lateral to the longitudinal axis of the carrots, said conveyer means being devoid of supporting elements for the carrots;

c. frame means for laterally tilting said conveyer means to urge sliding of the carrots toward the lower edge of said conveyer means;

d. plate means disposed beneath said conveyer means for supporting the carrots within and in contact with said conveyer means, said plate means including a terminal end disposed downstream of said discharge means for terminating support for the carrots within said conveyer means;

e. a base board disposed in proximity to the lower edge of said conveyer means for referencing the position of each carrot within said conveyer means;

f. gauge means extending downstream of said terminal end for selectively supporting only increasing longer ones of said carrots disposed within said conveyer means, said guage means including:

i. strip means extending downstream of said plate means for supporting the end of the carrots adjacent said baseboard; and ii. a plurality of increasing staggered length support rods extending downstream from said plate for providing another point of support for the carrots, said rods being in alignment with said strip means and displaced therefrom by ascending length; and g. at least one bin means for receiving carrots no longer supported by said gauge means;

whereby, said gauge means segregates the carrots by length by maintaining support only for increasingly longer carrots and permitting non-supported carrots to drop through said conveyer means into one of said bin means.

3. The apparatus as set forth in claim 2 wherein said aligning means includes:

a. a slanted feed chute having an upper input end and a lower output end, said lower output end including an aperture for discharging the carrots; and b. a pair of counter-rotating rollers for receiving the carrots from said aperture and conveying the carrots to said conveyer means.

* * * * *